US005216199A

United States Patent [19]

Bjerke et al.

[11] Patent Number: 5,216,199

[45] Date of Patent: Jun. 1, 1993

[54] LEAD-FREE PRIMED RIMFIRE CARTRIDGE

[75] Inventors: Robert K. Bjerke; Kenneth P. Kees; James P. Ward; Walter H. Stevens, all of Lewiston, Id.

[73] Assignee: Blount, Inc., Montgomery, Ala.

[21] Appl. No.: 726,588

[22] Filed: Jul. 8, 1991

[51] Int. Cl.[5] ..... F42B 5/32

[52] U.S. Cl. ..... 102/471; 102/204; 102/443; 149/61; 149/68

[58] Field of Search ..... 102/204, 430, 443, 444, 102/471, 530, 531; 86/29-33; 149/18, 61, 68

[56] References Cited

U.S. PATENT DOCUMENTS

| | | | |
|---|---|---|---|
| 966,163 | 8/1910 | Buell | 102/471 |
| 2,522,208 | 9/1950 | Catlin | 102/471 |
| 3,087,428 | 4/1963 | Frech, Jr. | 102/531 |
| 3,257,892 | 6/1966 | Hubbard | 102/471 |
| 3,423,259 | 1/1969 | Staba . | |
| 3,648,616 | 3/1972 | Hsu | 102/443 |
| 4,363,679 | 12/1982 | Hagel et al. . | |
| 4,566,921 | 1/1986 | Duguet . | |
| 4,581,082 | 4/1986 | Hagel et al. . | |
| 4,608,102 | 8/1986 | Krampen et al. . | |
| 4,674,409 | 6/1987 | Lopata et al. . | |
| 4,963,201 | 10/1990 | Bjerke et al. . | |

OTHER PUBLICATIONS

Brands, Raymond, "Elimination of Airborne Lead Contamination from Caliber .22 Ammunition," Technical Report ARCCS-TR-87003 (Picatinny Arsenal, NJ, 1987).

TM 9-1300-214, "Military Explosives," Chapter 10, 10-1.

PATR 2700, "Encyclopedia of Explosives," vol. 8, N 38.

PATR 2700, "Encyclopedia of Explosives," vol. 9, S 221.

"The Chemistry of Powder and Explosives," T. L. Davis, John Wiley & Sons, Inc. (1943), pp. 60-85.

"The Condensed Chemical Dictionary", Eighth Ed. Van Nostrand Reinhold Company 1971, p. 383.

*Primary Examiner*—Harold J. Tudor

*Attorney, Agent, or Firm*—Klarquist, Sparkman, Campbell, Leigh & Whinston

[57] ABSTRACT

A method of manufacturing an improved lead-free primed rimfire cartridge for ammunition or industrial powerloads providing a gas source for driving fasteners with power-fastening tools. A lead-free priming mixture is consolidated into an annular cavity of a rimfire casing and dried in the cavity. The primer is secured in the cavity by tamping at least a portion of propellant into the casing against and over the dried primer. The tamping pressure per casing may range from 1,300 psi to 8,800 psi. Any remaining portion of required propellent is added over the tamped compacted propellant layer. The ammunition and powerload casings are then sealed and finished in a conventional manner. A rimfire cartridge for both ammunition and industrial powerload applications manufactured as described above is also provided.

13 Claims, 2 Drawing Sheets

LEAD-FREE PRIMED RIMFIRE CARTRIDGE

BACKGROUND OF THE INVENTION

The present invention relates generally to a rimfire cartridge system, including a rimfire cartridge and to a method of making a rimfire cartridge, and more particularly to an improved rimfire cartridge having a primer free of toxic metals, for ammunition or industrial powerloads used in power-fastening tools to serve as a gas energy source for driving metal studs, fasteners and the like.

Rimfire cartridges heretofore have generally used priming compositions that produce a toxic gaseous exhaust product which includes compounds of lead, antimony or barium. Growing concerns about the effect on human health of these toxic exhaust product chemicals have led to investigations of new primer compositions. A desirable primer composition would have acceptable ignition properties and an impact sensitivity comparable to conventional primer compositions, while eliminating or reducing the undesirable chemical species in the exhaust product. Nontoxic exhaust product priming compositions are especially desirable for use in enclosed or inadequately ventilated places, such as indoor target ranges for ammunition, or enclosed construction sites for industrial powerloads.

The exhaust composition of a primer depends greatly upon the chemical system of the primer formulation. For example, nearly all of the current small arms primer formulations are based upon the impact-sensitive primary explosive, lead styphnate. The exhaust products of a lead styphnate primer formulation contain toxic lead or lead compounds. Small arms primer formulations also include an oxidizer component and a fuel component, with the conventional formulations having a barium nitrate oxidizer and an antimony sulfide fuel. Upon firing a conventionally primed rimfire cartridge, the barium nitrate and antimony sulfide also form undesirable gaseous toxins.

The formulation of a new lead-free, low toxicity exhaust primer mixture requires the elimination of the conventional substances used for the primary explosive, fuel and oxidizer. These components must be replaced with chemicals serving these same functions in the primer mixture to provide a new formulation. Such a new formulation must perform comparably with the former compositions, especially in the areas of impact sensitivity, thermal output and ignition characteristics.

A number of earlier investigations have focused on the primary explosive diazodinitrophenol, also known as "DDNP" or "dinol," (hereinafter "dinol") as a replacement for lead styphnate. While as an explosive dinol possesses certain desireable attributes, such as its nontoxic exhaust products of nitrogen, carbon oxides and water vapor, it also suffers various formulation difficulties. Additionally, while the impact sensitivity of dinol is roughly equivalent to that of lead styphnate, the sensitivity of dinol to friction is much less. Furthermore, dinol has a significantly higher detonation velocity than that of lead styphnate.

Other lead-free primer compositions have been proposed. One primer formulation using dinol is described in U.S. Pat. No. 4,363,679 to Hagel et al. The Hagel et al. formulation has a smokeless propellant, a titanium fuel, and a zinc peroxide oxidizer. Another primer formulation using dinol is disclosed in U.S. Pat. No. 4,608,102 to Krampen et al., which uses manganese dioxide as the oxidizer.

U.S. Pat. No. 4,674,409 to Lopata et al. (hereinafter, "Lopata") discloses a non-toxic, non-corrosive, lead-free rimfire ammunition cartridge. The primer mixture of Lopata consists essentially of manganese dioxide ($MnO_2$), tetracene, dinol and glass. The Lopata priming mix may include 10–40% by weight manganese dioxide, 25–40% by weight dinol (dependent upon the amount of tetracene, such that the combined weight percentages of dinol and tetracene are within the range of 40–60%) and 10–30% rimfire glass. The mixture is made by a wet process, where timer is spun into the interior rim of the casing. A 13% nitrated nitrocellulose foil sheet of a compacted propellant is located adjacent the primer composition to hold it in place for reliable ignition upon detonation of the primer. A lead-free metallic bullet, preferably of copper, is mounted within the open end of the casing.

Lopata's requirement of a separate foil disk which is inserted or pressed into contact with the priming mixture is considered to be a disadvantage for several reasons. First, the completed Lopata cartridge requires one whole extra part, i.e., the foil disk, which must be ordered, inventoried, handled and separately assembled into the finished cartridge. This extra foil disk part not only adds material cost to the overall cartridge, but it also increases the overhead and labor costs associated with material ordering, storage and handling.

A more detailed explanation of the Lopata cartridge is believed to be disclosed in Technical Report ARCCD-TR-87003 prepared for the U.S. Army Armament Research, Development and Engineering Center, Close Combat Armament Center, Picatinny Arsenal, N.J. by Raymond Brands, entitled "Elimination of Airborne Lead Contamination from Caliber 0.22 Ammunition," published in June 1987. On page 4 of this report, it states, "A thin layer of nitrocellulose foil was added to bond the primer mixture in place and provide additional ignition energy." The test results listed in this report are rather poor, showing a large number of misfires, and a follow-up program was recommended to complete the project. These disappointing results probably arose from a number of factors, not the least of which would be the use of manganese dioxide, a low oxidizer ratio and the thin foil seal. The degree of success of the Lopta cartridge is perhaps best indicated by the fact that the assignee of this patent apparently has no product currently on the market covered by the Lopata patent.

A lead-free primer composition is disclosed in U.S. Pat. No. 4,963,201 to Bjerke et al. (hereinafter "Bjerke"), which is herein incorporated by reference for the teachings and disclosures therein. The co-inventors of the invention illustrated herein are among the co-inventors of the Bjerke patent and they are also employed by the assignee of both the Bjerke patent and the subject matter described herein. The Bjerke patent discloses a lead-free primer composition for use in the cup-like primers of centerfire ammunition. The Bjerke primer composition comprises dinol or potassium dinitrobenzofuroxane as the primary explosive, nitrate ester as ,the fuel, and strontium nitrate as the oxidizer.

These prior patents focused on combinations of primary explosives, fuels, and oxidizers which would perform comparably to the conventional small arms primer compositions without producing potentially harmful exhaust products. However, these new compositions had varying degrees of success, mainly because they differ radically in chemical ingredients from the conventional lead styphnate compositions. Consequently, the new compositions possessed to some degree different thermodynamic characteristics than the conventional primer compositions. Moreover, with the exception of the Lopata patent discussed above, these compositions were developed specifically for centerfire ammunition applications, rather than for rimfire applications.

Rimfire ignition differs significantly from centerfire ignition so it is apparent that a primer composition which is suitable for centerfire cartridges may not perform adequately in rimfire applications. A comparison of rimfire and centerfire cartridges and their manners of detonation will clarify this.

For a rimfire cartridge, the primer mixture is deposited in an integral annular rim cavity in the interior of the case head. For a centerfire cartridge, the case head has a pocket for receiving a replaceable centerfire primer. A replaceable centerfire primer has a separate metal cup into which the primer mixture is placed and dried. The centerfire primer cup may then be equipped with an anvil to aid in detonation. The completed primer is then seated in the pocket of the centerfire case head.

For both rimfire and centerfire cartridges, after the primer is in place a propellant, which is commonly known as gun powder, is added to the casing. For ammunition purposes, a bullet is then seated and crimped at the open mouth of the casing to complete the cartridge. For a rimfire industrial powerload, the open mouth of the casing is sealed closed by crimping the casing mouth shut.

In use, for centerfire ammunition, a firing pin strikes the replaceable metal cup containing the primer. For rimfire ammunition, a firing pin strikes the casing rim. Rimfire casings are not intended to be reusable, but centerfire casings which receive replaceable primer cups may be reused. In both rimfire and centerfire cartridges, the impact force of the firing pin detonates the primer. The detonated primer ignites to provide a resultant thermal output energy pulse of gas, thermal energy and hot particles which in turn ignites the propellant. The distribution of impact force from the detonated primer to the propellent is quite different in the rimfire and centerfire configurations.

During centerfire detonation, the primer ignition takes place within the primer cup. The resultant gas expansion and thermal pulse are directed toward the propellant charge through a flash hole in the pocket of the centerfire casing.

During rimfire detonation, the pinching action of the firing pin permanently deforms the casing rim at a point near the outer edge of the case head. The rimfire primer ignites at this pinching point of impact then combusts very rapidly around the interior of the annular rim. The resultant gas expansion and thermal pulse in the rimfire case head ignite the propellant charge.

Since a rimfire casing is not indexed within the firing chamber, the firing pin may strike the casing anywhere along the 360° circumference of the casehead. If the primer is not evenly distributed around the interior circumference of the casehead, the cartridge may malfunction, creating an insufficient or an excessive energy pulse. An excessive energy pulse can cause premature detonation of the propellant, or cause the bullet to move prematurely or a powerload crimp to open prematurely. An insufficient energy pulse produces poor ignition and a subsequent low rate of burn for the propellant, which could cause a misfire or other undesirable "squib" conditions.

In earlier studies, we, the inventors of the invention illustrated herein, found that friction forces play a more important role in the impact sensitivity for rimfire applications than for centerfire applications. This factor is exemplified in the conventional lead styphnate formulations where it has been determined that a frictionator or physical sensitizer, such as ground glass, is necessary to achieve the requisite impact sensitivity for rimfire use. Thus, a primer formulation which meets the sensitivity requirements for a centerfire application very often exhibits extremely poor impact sensitivity for a rimfire application.

Thus, a need has existed for an improved lead-free primed rimfire cartridge system for ammunition and industrial powerloads, which overcomes and is not susceptible to, the above limitations and disadvantages.

SUMMARY OF THE INVENTION

In accordance with the present invention, a rimfire cartridge is provided having a lead free primer composition including diazodinitrophenol (dinol), tetracene, propellant, glass, and strontium nitrate.

Further, in accordance with an illustrated embodiment of the present invention, a method is provided of manufacturing a rimfire cartridge including the steps of consolidating a wet, lead-free primer mixture into the annular cavity formed within the enclosed end of a rimfire casing, and then drying the primer mixture. The primer is secured in the cavity by metering at least a portion of the propellant charge into the casing and tamping the propellant in place. The tamped propellant layer secures the primer within the cavity. Any remaining amount of propellent required may then be added over the tamped propellant layer. Alternatively, the entire propellant charge may be loaded into the casing and tamped. The open end of the casing is finally sealed, either with a bullet for ammunition applications, or by crimping for industrial powerload applications.

It is an overall object of the present invention to provide an improved lead-free primed rimfire cartridge and method of manufacturing the same, for both ammunition and industrial powerload applications.

A further object of the present invention is to provide an improved lead-free primer composition for use in rimfire cartridges.

A further object of the present invention is to provide an improved rimfire cartridge which upon detonation does not produce toxic compounds.

Still another object of the present invention is to provide an improved lead free primed rimfire cartridge which fires reliably.

The present invention relates to the above features and objects individually as well as collectively. These and other objects, features and advantages of the present invention will become apparent to those skilled in the art from the following description and drawings.

DETAILED DESCRIPTION OF THE PREFERRED EMBODIMENTS

Figure 1:
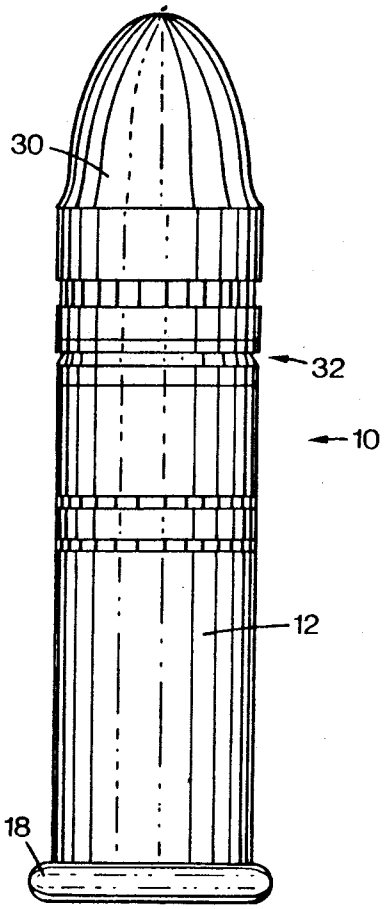
FIG. 1 is a side elevational view of one form of an assembled small caliber rimfire cartridge of the present invention.
Figure 2:
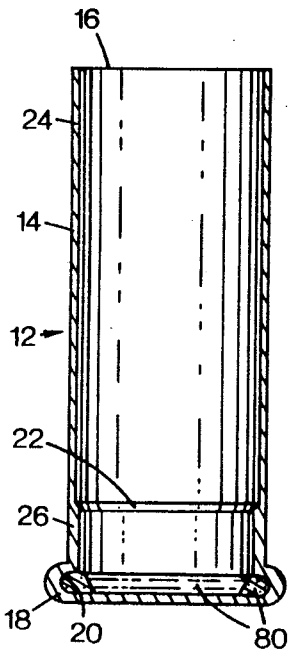

FIG. 1 illustrates an embodiment of a rimfire ammunition cartridge or round 10 constructed in accordance with the present invention which is typically used for small caliber ammunition, such as 0.22 caliber. Referring also to FIG. 2, the cartridge 10 includes a generally cylindrical rimfire casing 12 having a casing wall 14 terminating in an open end or case mouth 16 and an enclosed end or case head 18. The case head 18 protrudes beyond the casing wall 14 to form an annular recess or cavity 20 within the casing interior. The Casing wall 14 may have different thicknesses as shown in FIG. 2, with a shoulder 22 separating a thin wall portion 24 from a thick wall portion 26. The casing 12 is typically made of brass, aluminum alloys or the like.

As shown in FIG. 1, the rimfire ammunition cartridge 10 also includes a projectile, such as a bullet 30 which is seated at the case mouth 16 by crimping the casing against the bullet, with the crimping indicated generally at 32. As is conventional, the bullet 30 may be made of lead or lead alloys. However, preferably to enhance the lead-free nature of the overall ammunition cartridge 10, the bullet 30 may be of copper or plastic, or to minimize lead contamination a lead bullet may be used having a relatively thick copper jacketing or coating.

Figure 6:
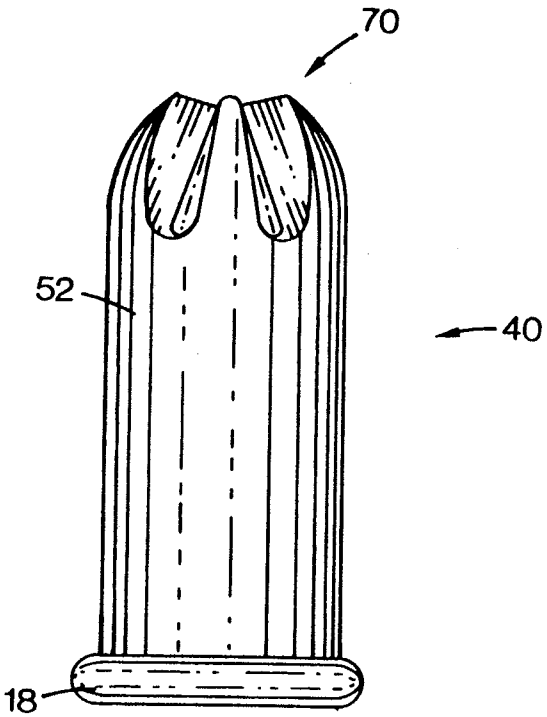
FIG. 6 is a side elevational view of one form of an assembled industrial powerload rimfire cartridge of the present invention.

FIG. 6 illustrates an embodiment of a 0.22 caliber industrial powerload cartridge or powerload 40 constructed in accordance with the present invention. The powerload 40 is typically used in power-fastening tools to serve as a gas energy source for driving metal studs, fasteners and the like. Powerloads 40 are typically supplied in 0.22, 0.25 or 0.27 caliber sizes.

Figure 8:
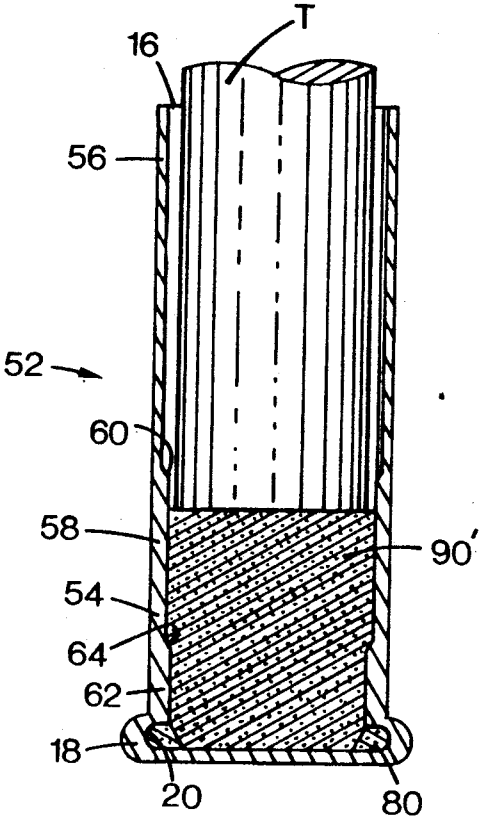
FIGS. 7 and 8 are cross sectional elevational views of the powerload casing of FIG. 6, shown during two stages of manufacture.
Figure 7:
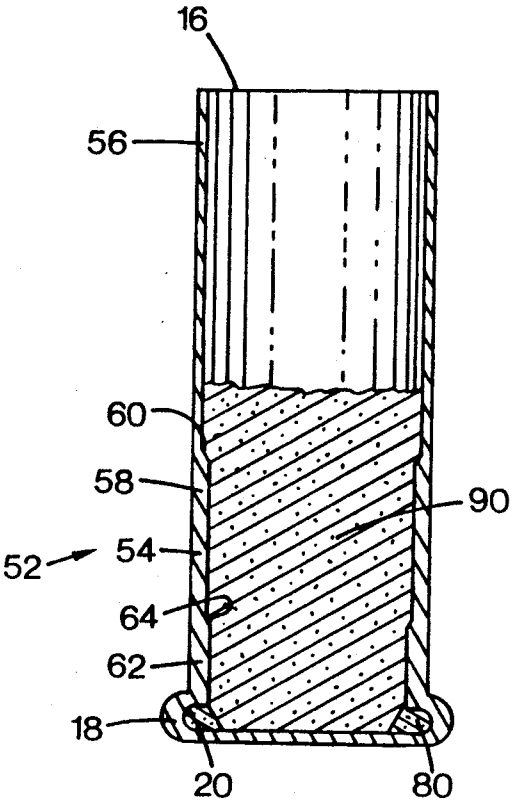

Referring also to FIGS. 7 and 8, the powerload 40 includes a casing 52 having a casing wall 54. The casing wall 54 terminates in an open end or case mouth 16 and an enclosed end or case head 18 as described for the rimfire ammunition cartridge 10 of FIGS. 1-5. The casing wall 54 may have a varying thickness, such as a thin wall portion 56 separated from a medium wall portion 58 by a first upper shoulder 60, and a thick wall portion 62 separated from the medium wall portion 58 by a second lower shoulder 64. The case head 18 of the powerload casing 52 also projects outwardly beyond the casing wall 54 to form an annular cavity 20 as described for the rimfire ammunition cartridge embodiment 10. As shown in FIG. 6, the open case mouth end 16 of powerload 40 may sealed by crimping the casing 52 with a conventional star-type crimp 70. Alternatively, the powerload casing 52 may be sealed with a rolled-type crimp (not shown) securing a wad of paper or nitrocellulose or the like, which is commonly known as a wad crimp.

In accordance with the invention, a primer or primer charge 80, having a composition as set forth hereinafter, is deposited in the casing annular cavity 20 in a manner described further below. In a preferred embodiment, the primer 80 of the present invention comprises dinol as an impact-sensitive initiating explosive; tetracene as a thermal chemical sensitizer; ground glass as a friction-producing agent or physical sensitizer; a double base propellant, such as a mixture of nitroglycerin and nitrocellulose, as fuel; and strontium nitrate as an oxidizer. Alternatively, a single base propellant, such as nitrocellulose, or a triple base propellant, such as a mixture of nitrocellulose, nitroglycerin and a secondary explosive, may also be used as the fuel. Thermal chemical equilibrium computations were utilized to ascertain those ingredients and amounts necessary to achieve the desired ignition pulse characteristics and exhaust compositions. Further studies were conducted using statistical design D-optimal mixture experiments to establish a relationship between formula variation and drop test heights, drop test variations and various handling properties (see Table 3 below). Table 1 sets forth the range of ingredients which we found to be desirable.

TABLE 1

| INGREDIENTS | |
|---|---|
| Component | Percent Weight (dry basis) |
| dinol (diazodinitrophenol) | 20-30% |
| tetracene | 4-20% |
| propellant | 0-12% |
| ground glass | 20-35% |
| strontium nitrate | 20-40% |
| water-soluble glue | 0.2-2.2% |

We have found that certain discrete stoichiometric ratios were necessary to optimize the impact sensitivity performance of the primer charge 80. Furthermore, we have found that the combination of friction forces inherent in the rimfire primer ignition phenomena, as well as the relatively poor friction sensitivity of the primary explosive dinol, necessitated a new method of restraining or confining the primer charge 80 within the annular cavity 20 until complete combustion of the primer charge 80 could occur. Without such restraint, even the optimum combinations of these ingredients of primer 80 would often result in a partial ignition of the primer in the annular cavity 20.

Any occasional failure of the rimfire primer charge 80 to propagate both rapidly and fully may result in highly undesirable "squib" conditions, partial or slow ignition of the propellant charge, reduced friction energy, and an anomalous time interval for the output of the round. Any of these undesirable conditions may contribute to misfires.

Commonly in the art, small amounts of a binder or glue are added to primer compositions. For safety reasons, these primer compositions are desensitized during processing and handling by blending and charging the primer compositions with certain amounts of water present. The preferred range of water in the wet composition, depending upon the amount of water introduced with the dinol and tetracene (each being mixed with water to insure safe handling), is 14-24% water, with a particularly preferred amount being in the range of 14.5-15.5% water. After the primer charge is deposited or charged into a rimfire case head 18, and consolidated in the cavity, such as by spinning, the primer charge is fully dried. The binder serves to hold the primer charge together as an integral mass, as well as to provide adherence to the casing metal surfaces defining the annular cavity 20. For many years, natural water-soluble gums, such as gum arabic (technical acacia) and tragacanth were used in combination with gelatins to make various priming mixture binders. Typically, the amount of binder required in the primer composition was very minute, ranging anywhere from 0.2–0.5% of the total dry weight.

We investigated the use of various amounts of these natural gum solutions, certain water-soluble polymers, such as polyvinylpyrrolidone and polyvinyl alcohols, various types of after-charge air-polymerized glues, such as cyanoacrylates and ordinary mucilages. These various binders met with varying degrees of success, depending on the type and amount of binder employed in the primer composition. However, even with a binder the primer of the composition set forth in Table 1 has a tendency to "knock-out", that is to be displaced from the rim cavity 20 before full ignition occurs, resulting in partial ignition rather than full propagation.

The knock-out tendency of this dinol-containing primer composition is enhanced due to the brisant (derived from the French word for "shattering effect") nature of the primer 80. Additionally, this knock-out tendency is believed to be due to the relative insensitivity to friction of the dinol-containing primer, and the addition of a binder alone did not appear capable of fully overcoming this friction insensitivity. Dinol is less sensitive to friction impact than the previous lead styphnate compounds which were used, and thus ignition is more difficult with a dinol-containing primer composition.

We then conducted further studies of other physical methods of holding the primer charge 80 in place in the annular cavity 20 long enough to permit complete ignition. We found that to some extent ignition could be improved somewhat in the manner of the Lopata patent discussed above, by positioning a thin cylinder of flammable material (not shown) against the primer 80 deposited within the annular cavity 20. We evaluated several cylinders of varying types of ethylcellulose and nitrocellulose having varying thicknesses, and seals of paper and vinyl, all of which gave disappointing results. Typically, one side of the seal would loosen and extinguish the combustion flame. Although some types of these cylinders improved impact sensitivity, the cylinders appeared to interfere with the propellent ignition sequence in some instances. Furthermore, these flammable thin cylinders were difficult to handle and difficult to consistently manufacture within tolerance requirements.

Figure 4:
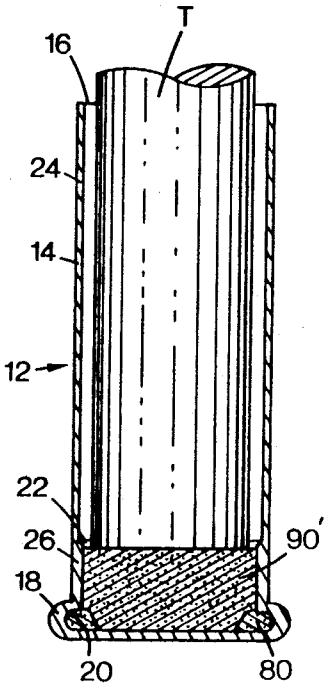

We have found that "knockout" can be prevented and substantially complete ignition of the primer obtained by locking or securing the primer within the cavity 20 by tamping a portion of an appropriate propellant charge 90 (see FIGS. 3 and 7) into the cavity within and over the consolidated annular primer charge 80. This tamping may be accomplished using a tamping pin or tool T as shown in FIGS. 4 and 7, and may advantageously be used with conventional rimfire casings, such as casings 12 and 52.

For example, successful results have been obtained (see Tables 4–8 and 10) using a tamping tool T having a diameter of approximately 0.196 inches for 0.22, 0.25, and 0.27 caliber casings. Other configurations and sizes of tamping tools may also be used. For instance, an approximately 0.220 inch diameter tamping tool T may be used for 0.27 caliber casings, and an approximately 0.170 inch diameter tool T may be used for necked-down 0.22 caliber powerload casings (not shown).

Tamping the propellant charge 90 of a single cartridge with 50–200 pounds of force provides a mass of a tamped propellant layer 90' (see FIGS. 4 and 8) which produces desirable results. Given this range of pounds of force per casing, and the range of tamping tool approximate diameters, a tamping pressure may be expressed in terms of pounds of force per square inch (psi) of the tamping tool head area which contacts the propellant 90. Therefore, the tamping pressure per casing may range from 1,300 psi to 8,800 psi. In a more preferred embodiment, the propellant charge 90 for a single cartridge may be tamped with a tamping tool T at 70–100 pounds of force per casing 12 or 52. Using the tamping tool sizes illustrated above, the tamping pressure per casing for this embodiment may range from 1,850 psi to 4,400 psi.

This tamping action causes the mass of interlocking propellant particles 90' to spread relatively evenly against and over the primer charge 80 and adhere tightly to the interior of the rimfire casing 12 or 52. We have found that a minimum of 50 mg of flake propellant was sufficient to accomplish this purpose for a 0.22 caliber ammunition cartridge 10 or powerload 40. Alternatively, a ball propellant may also be used.

Tamping of a propellant charge in a rimfire case has been performed in the past to accomplish other goals. The purpose of these prior tamping operations was to achieve a certain weight of charge within the cartridge where insufficient case volume existed. However, locking the primer 80 in place, for example by the specified tamping of the propellant charge 90 as described above, greatly enhances the primer performance and serves as an integral part of rimfire cartridge having a lead-free, non-toxic primer charge 80. The tamped propellant layer 90' serves to secure the primer charge 80 in place by locking it into the annular cavity 20. Furthermore, we believe that the uniform specified tamping of the propellant charge 90 of the present invention uniquely provides a reliable rimfire ammunition cartridge 10, and a reliable powerload 40, using conventional rimfire casings without requiring additional components.

One preferred priming composition of the, present invention contains dinol as the initiating or primary explosive. Dinol may be synthesized from sodium picramate hydrochloric acid and sodium nitrite by known and accepted methods. The dinol is washed and stored in conductive containers at 25–35% water.

Tetracene is used as a chemical sensitizer in the preferred embodiment of the primer composition. Tetracene may be manufactured by known and acceptable methods from aminoguanidine bicarbonate, sodium nitrite and acetic acid. The tetracene is then washed and stored at 35–40% water. We found that at least 4% tetracene in the priming mixture is required to achieve a desirable sensitivity. Preferably, the presence of tetracene in at least 6%, provides more consistent standard deviations about that sensitivity.

The preferred primer composition has ball propellant of 0.015–0.018 inch diameter as a fuel. The preferred propellant is offered by the Olin Corporation of Stamford, Conn., under the identification of #WC669. It consists of spheres of about 0.015 inch diameter containing 10% nitroglycerin and 90% nitrocellulose. In this embodiment, the propellant provides an additional thermal pulse and appears to enhance some of the priming composition blending and charging operations. This preferred primer composition also includes between 20% and 35% of standard rimfire ground glass, which acts as a physical sensitizer or frictionator. The glass acts as a frictionating agent during the translational force distribution which occurs upon impact of a rimfire firing pin.

The preferred primer composition has a strontium nitrate oxidizer. A strontium nitrate oxidizer is preferred over the manganese dioxide oxidizer used in the Lopata patent. Manganese dioxide is a relatively poor oxidizer in terms of the available oxygen provided which is needed to maintain a proper fuel oxidizer balance. Strontium nitrate is a much better oxidizer because it has more available oxygen per unit weight than manganese dioxide. Additionally, the brisant nature of dinol further contributes to provide an overall more brisant primer composition, and disadvantageously results in the average molecular weight of the exhaust products being lighter than that achieved with the previous lead styphnate compositions.

The moisture equilibrium problems typically associated with anhydrous strontium nitrate and tetrahydrate strontium nitrate are addressed by the methodology set forth in the Bjerke patent. This oxidizer provides oxygen for combustion and, at specific stoichiometries, it adds to the thermal output of the primer composition. The oxidizer is also a source of hot particulate in the exhaust of this primer composition. A water-soluble glue or binder may also be used to secure the dry charge together as an integral mass. An identification- pigment, such as ferricferrocyanide, may also be added to the primer composition to impart a greenish color to the mixture which aids in quality control visual inspection of the primed casing.

The primer is manufactured in a manner similar to current formulations, and of course, safety is of great concern. For example, wet dinol, wet tetracene and a dissolved glue are typically weighed and blended in a remotely controlled mixer. Then a weighed portion of ball propellant, if desired, is blended into the mixture, followed by a weighed amount of the ground glass as the physical sensitizer. A desired amount of oxidizer is then weighed and added to the mixture. For safe handling purposes, the resulting damp primer mixture should contain 12–18% water.

The damp primer mixture is preferably stored in a conductive rubber container until needed. A portion of the damp mixture is "charged" by rubbing the mixture into holes in a perforated "charge-plate" (not shown) to form cylindrical wet pellets. The cylindrical wet pellets are preferably transferred to the rimfire cases by means of aligned pins (not shown) which push each pellet from its forming hole in the charge-plate into a single rimfire casing 12 or 52. In a typical embodiment, the charge-plate may have several hundred holes therethrough so that multiple casings may be charged simultaneously.

The primer is then consolidated, deposited or packed into the annular cavity 20, for example, such as by pressing or spinning. For instance, spinning may be accomplished in a conventional manner by means of rapidly rotating spinners (not shown) which enter each firmly held casing 12 or 52 and spread the wet primer mixture pellet downwardly. The spinning force also uniformly packs the mixture outwardly into the annular cavity 20 as shown in FIG. 2 (also known as a "spun casing"). After the charging and consolidating operations, the wet primer mixture is dried, for example by exposing the casings 12 or 52 to warm air as discussed further below.

Figure 3:
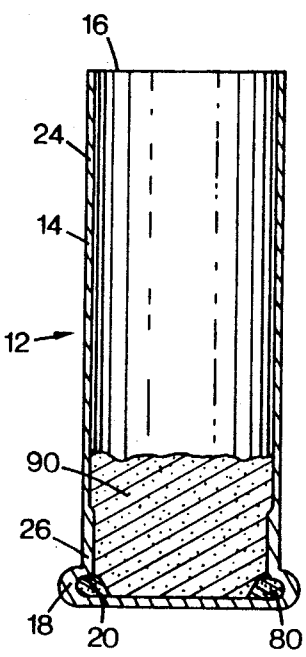

FIGS. 3 and 4 illustrate the tamping operation following consolidation and drying of the primer charge. First, a desired type and predetermined amount of propellant 90, such as flake or ball propellant, is metered into the casing 12. One suitable fairly fast burning propellant is sold under the trademark HERCULES PC-1, manufactured by the Hercules plant at Kenvil, N.J., although a variety of other propellants would also be suitable. This PC-1 propellant has specifications listed in Table 2 below.

TABLE 2

HERCULES PROPELLANT SPECIFICATIONS

| | PC-1 | 351 | SS-255F |
|---|---|---|---|
| % Nitrocellulose | 60 | 65% | 75% |
| % Nitroglycerin | 40 | 35% | 25% |
| Cuts per Inch | 275 | 125 | 320 |
| Die (Avg. Diam.) | .043 | .043 | .078 |
| Relative Burning Speed | 81.9* | 54.0* | 100.0 |

*Note: The burning speed for PC-1 and 351 is referenced to that of the Hercules propellant SS-255F, shown in the third column of Table 2.

In accordance with the invention, at least 50 mg of propellant is metered into a 0.22 caliber casing 12 (see FIG. 3). This metering step may be performed by a conventional plate operation (not shown). The actual tamping portion of the tamping operation may be performed in a remote cell (not shown) for safety. The tamping tool T is inserted into the casing 12 and the loose propellant 90 is tamped with a tamping pressure selected from the range of 1,300–8,800 psi. The tamping pressure selected will depend upon the type of propellant 90 used, as well as the moisture and volatility of the propellant which may vary from lot to lot of propellant. Another particularly preferred tamping pressure range is 1,850–4,400 psi. For example, using a tamping tool T having approximately a 0.196 inch diameter, and a tamping pressure selected from a range of 2,300–3,300 psi, has provided suitable sensitivity outputs for cartridges assembled with the HERCULES PC-1 propellant described in Table 2. Of course, the tamping pressure may also vary with the configuration and shape of the tamping pin, the propellent size and type, the casing size, etc. The optimal tamping pressure for a particular cartridge, propellant lot, tamping pin, etc., may be empirically determined by testing the sensitivity (as described further below) of sample rounds to determine what tamping force is required to produce this optimal tamping pressure which provides a minimal standard deviation (sigma).

Figure 5:
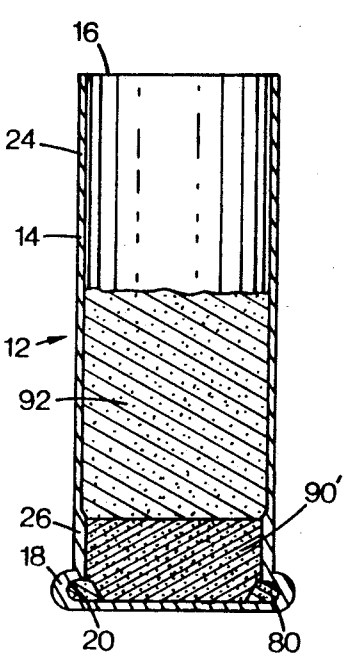
FIGS. 2-5 are cross sectional elevational views of the cartridge casing of FIG. 1, shown during various steps of manufacture.

As a result of the tamping operation, a compacted layer of tamped propellant 90' is provided as shown in FIGS. 4 and 5, which secures and locks the primer charge 80 in place within cavity 20. If further propellant charging is required to provide the desired explosive force and resulting bullet velocity, the additional propellant 92 is added over the compacted propellant layer 90' by metering the propellant 92 into the casing 12, for example, by using a conventional plate operation. The additional propellant 92 may be the same as the tamped propellant 90', or of a different composition. In the preferred embodiment for an ammunition cartridge 10, the additional propellant 92 is that sold under the trademark HERCULES 351, also manufactured by the Hercules plant in Kenvil, N.J., although a variety of other propellants would also be suitable. Specifications for the HERCULES 351 propellant are given in Table 2 above. The fully charged round as shown in FIG. 5 is then finished by seating a bullet 30 in the case mouth 16, and by crimping the case mouth as indicated at 32 to secure the bullet in place.

Referring to FIGS. 7 and 8, the tamping operation for an industrial powerload 40 is illustrated. In FIG. 7, the primer 80 has already been consolidated, such as by pressing or spinning, into the annular cavity 20, as described above for the ammunition cartridge 10 of FIG. 2. FIG. 7 shows a desired type and amount of loose propellant 90 metered into the powerload casing 52 over the dried primer 80, such as by a conventional plate operation. In the preferred embodiment, the propellant 90 for the powerload 40 is the HERCULES PC-1 propellant of Table 2, although a variety of other propellants would also be suitable. For a 0.22 caliber powerload, at least 50 mg of propellant is metered into the casing 52 over the dried primer and tamped using tamping tool T. The tamping pressure used may be selected between 1,300 and 8,800 psi. Preferably, the tamping pressure is selected from the range of 1,850 and 4,400 psi. The compacted propellant layer 90' secures and locks the primer 80 in place within the cavity 20.

The amount of loose propellant 90 which is tamped to form the compacted propellant layer 90' may be the entire propellant charge required for the powerload, only 50 mg of the entire propellant charge, or some portion therebetween. Powerloads 40 are typically supplied at various power ratings, with the power rating being determined by the total amount of tamped propellant 90 and any loose propellent (not shown) added to the casing 52. If a fractional amount of the entire propellant charge is tamped, then additional loose propellant (not shown) may be added as required to the casing 52 in the manner shown and described with respect to FIG. 5. Typically, only one type of propellant is used in a powerload 40, although if required, additional loose propellant could be of a type other than the tamped propellant, as described above with respect to the propellant used in the ammunition cartridge 10. The final step of manufacturing the powerload 40 is illustrated in FIG. 6, where the case mouth 16 is crimped closed, for example by the star-type crimping 70, to seal the casing from moisture and the like, as well as to secure the propellant therein.

From the following description, it is apparent that the various ingredients may be varied within the constraint that the resultant oxygen balance is determined by the fuel/oxidizer ratios. The energy output of the primer varies significantly as the fuel/oxidizer ratios change. Additionally, we have found that certain fuel/oxidizer ratios bear directly on the impact sensitivity characteristic of the resulting primer.

The preferred ranges of chemical ingredient components of the present invention are given in Table 1, above. In arriving at the preferred embodiment, a variety of primer compositions were tested using statistical design D-optimal mixture experiments to establish a relationship between formula variation and drop test heights, drop test variations and various handling properties. Twelve representative example test compositions are shown in Table 3 below.

TABLE 3

| | TEST COMPOSITIONS | | | | | |
|---|---|---|---|---|---|---|
| | DINOL | TET | PROP | GLASS | STRNIT | TITAN |
| A | 0.2925 | 0.05139 | 0.0505 | 0.2016 | 0.3584 | 0.02529 |
| B | 0.2833 | 0.1 | 0.1 | 0.1 | 0.3467 | 0.05 |
| C | 0.3499 | 0 | 0 | 0.1 | 0.4801 | 0.05 |
| D | 0.2136 | 0 | 0.1 | 0.3 | 0.3166 | 0.05 |
| E | 0.3222 | 0 | 0.1 | 0.3 | 0.2578 | 0 |
| F | 0.2545 | 0.1 | 0.1 | 0.1 | 0.4255 | 0 |
| G | 0.2278 | 0.1 | 0 | 0.3 | 0.3022 | 0.05 |
| H | 0.3833 | 0 | 0.1 | 0.1 | 0.3467 | 0.05 |
| J | 0.3889 | 0.1 | 0 | 0.1 | 0.3911 | 0 |
| K | 0.3778 | 0 | 0 | 0.3 | 0.3022 | 0 |
| L | 0.209 | 0.1 | 0 | 0.3 | 0.371 | 0 |

TABLE 3-continued

| | TEST COMPOSITIONS | | | | | |
|---|---|---|---|---|---|---|
| | DINOL | TET | PROP | GLASS | STRNIT | TITAN |
| M | 0.3999 | 0 | 0 | 0.1 | 0.4801 | 0 |

Of the twelve samples A-M (with the letter I being omitted), the relative percentages by dry weight (if the values listed were multiplied by 100) of the various ingredients are shown, with dinol being listed in the first column, followed by tetracene (TET), propellant (PROP), glass, strontium nitrate (STRNIT) and titanium (TITAN). Each composition of Table 3 samples A-M also included 2% by weight of muCilage. Sample A represented a mid-point composition, around which the components of the various other samples were clustered. The embodiments containing titanium were eventually rejected.

The Small Arms Ammunition Manufacturers Institute (hereinafter SAAMI) sets forth rimfire ammunition specifications including impact sensitivity requirements that relate drop-test data to firing pin energies. This drop-test is performed by dropping a metal ball of a known weight from various heights onto a firing pin and fixture containing a test cartridge. Typically fifty rounds are tested at each required height. The average fire height or H-bar is defined as the level at which 50% of the test rounds fire. SAAMI defines acceptable ammunition specifications of an "all fire" height of H-bar plus four sigma ($+4\sigma$, with sigma being the standard deviation), and a "no fire" height of H-bar minus two sigma ($-2\sigma$).

The sample primer compositions A-M shown in Table 3 were evaluated, and the results are shown in Table 4 below. The various parameters tested during this D-optimal experiment aided in identifying the ingredient effects on the sensitivity and charging characteristics of the primer composition.

TABLE 4

| | TEST RESULTS | | | | | | |
|---|---|---|---|---|---|---|---|
| | SPIN | CHARGE | H-BAR | SIG-MA | PICK-OUT | MOIST | PEL WT |
| A | 0 | 0 | 5.26 | 1.24 | 106 | 0.17 | 24.2 |
| B | 1 | 0 | 6.8 | 1.4 | 709 | 0.171 | 23.8 |
| C | 0 | 1 | 6.98 | 1.57 | 2 | 0.355 | 22.2 |
| D | 1 | 1 | 6.98 | 1.65 | 23 | 0.121 | 22.4 |
| E | 1 | 1 | 5.62 | 1.12 | 8 | 0.146 | 24.4 |
| F | 0 | 0 | 6.8 | 1.04 | 109 | 0.179 | 22.4 |
| G | 0 | 1 | 4.46 | 0.91 | 4 | 0.152 | 28.3 |
| H | 1 | 0 | 6.66 | 1.59 | 510 | 0.203 | 22.5 |
| J | 0 | 0 | 5.84 | 1.06 | 166 | 0.202 | 24.2 |
| K | 0 | 1 | 5.04 | 0.98 | 6 | 0.169 | 23.8 |
| L | 1 | 1 | 6.7 | 1.07 | 1 | 0.142 | 23.3 |
| M | 1 | 1 | 7.54 | 1.95 | 0 | 0.168 | 21.3 |

In these experiments, the consolidation of the primer 80 into the cavity 20 was accomplished by spinning. Thus, in the first column of Table 4 "spin" is evaluated, that is, whether the composition was easy or difficult to spin into the primer cavity 20. The column labeled "charge" refers to the ease of handling the sample compositon during the charging plate operation where the primer is added to the casing. For both the columns labeled "spin" and "charge" the numeral zero (0) indicates a poor characteristic, and the numeral one (1) indicates an acceptable characteristic. The columns labeled "H-bar" and "sigma" are as described above with respect to the drop test. The column labeled "pick-out" refers to the number of casings which were culled from the lot by visual inspection, some having defects of being only half charged or having no primer charge in the casing. The column labeled "moist" refers to the percent water in the mixture, which varies depending upon the amount of dinol and tetracene in the compositon. The final column labeled "pel wt" refers to the weight of the primer pellet going into the casing, which of course varies by the primer charge mixture.

A desirable primer composition shown in Table 5 was prepared according the manner set forth in Table 6 for both powerload and ammunition cartridges. A buttet 30 was seated and crimped into each charged casing 12 in a conventional manner (see FIG. 1) and sealed in a convectional manner. Each charged powerload casing 52 was crimped in a conventional manner with a star-type crimp (see FIG. 6), and sealed in a conventional manner. The performance characteristics of the cartridges prepared in accordance with Tables 5 and 6 are shown in Table 7 and 8. In preparing these test rounds, the consolidation of the primer 80 into the cavity 20 was accomplished by spinning.

TABLE 5

PRIMER COMPOSITION

| Component | Percent Weight (dry basis) |
|---|---|
| dinol (diazodinitrophenol) | 22% |
| tetracene | 6% |
| propellant | 8% |
| glass | 30% |
| strontium nitrate | 32% |
| mucilage | 2% |

TABLE 6

TEST CARTRIDGE PREPARATION

| OPERATION | POWERLOAD | AMMUNITION |
|---|---|---|
| | PRIMING | |
| primer charging: | | |
| 15% wet mixture | 25 milligrams wet mixture | 22 milligrams wet mixture |
| spinning: | | |
| approx 2600 rpm min. 3 lb pressure | fill cavity with compact wet mixture | fill cavity with compact wet mixture |
| vacuum oven drying: | | |
| 110° ± 5° F., at 28 inches Hg | 2 cycles @ 30 minutes | 2 cycles @ 30 minutes |
| | LOADING | |
| caliber | .27 short (red) | .22 Hi-speed |
| plate load | 1200/plate 230 mg HERCULES PC-1 propellant Tamped at 100# | 1190/plate 50 mg HERCULES PC-1 propellant Tamped at 100# 2nd charge: 85 mg HERCULES 351 propellant (No Tamping) |

The performance of an ammunition cartridge is generally measured in terms of chamber pressure and bullet exit velocity. Table 7 is an example of typical test results for a sample group of fifty rimfire ammunition cartridges prepared in accordance with Table 6 . Currently, nearly 30,000 ammunition rounds 10 have been prepared in accordance with the method illustrated in Table 6, and sampled lots continue to fall near the typical values listed for the example in Table 7. It is apparent to those skilled in the art that the data given in Table 7 indicates satisfactory performance for the rimfire ammunition prepared in accordance with the preferred embodiment.

TABLE 7

RIMFIRE AMMUNITION
LONG RIFLE HIGH VELOCITY

| | Example | | Typical Styphnate |
|---|---|---|---|
| average fire height | 4.11" | 2 oz. ball | 3.15" |
| standard deviation | 0.95" | | 0.76" |
| average pressure | 21800 psi | | 21500 psi |
| standard deviation | 1180 psi | | 1000 psi |
| average velocity | 1247 fps | | 1240 fps |
| standard deviation | 21 fps | | 15 fps |

Similarly, the Powder Actuated Tool Manufacturing Institute (hereinafter PATMI) determines impact sensitivity requirements for powerloads. The PATMI sensitivity testing is performed in the same manner as described above for the SAAMI rimfire ammunition drop-test. PATMI defines acceptable powerload sensitivity specifications as a "all fire" height of H-bar plus four sigma ($+4\sigma$), and a "no fire" height of H-bar minus two sigma ($-2\pi$).

The performance of a powerload cartridge is generally measured in terms of fastener exit velocity and the resulting penetration of a fastener driven by the powerload. Table 8 is an example of typical test results for a sample of fifty powerload cartridges 40 prepared in accordance with Table 6. Currently, nearly 75,000 powerloads 40 have been prepared in accordance with the method illustrated in Table 6, and sampled lots continue to fall near the typical values listed for the example in Table 8. It is apparent to those skilled in the art that the data given in Table 8 indicates satisfactory performance for the rimfire powerloads prepared in accordance with the preferred embodiment.

TABLE 8

RIMFIRE POWERLOADS - 6.8/11 mm

| | Example | | Typical Styphnate |
|---|---|---|---|
| average fire height | 5.70" | 2 oz. ball | 5.80" |
| standard deviation | 1.22" | | 1.15" |
| no-fire height | 3.27" | | 3.20" |
| all-fire height | 10.66" | | 9.75" |
| penetration | 14.76 mm | | 16.7 mm |
| velocity | 609 fps | | 605 fps |

Thus, from the results of both Tables 7 and 8, it may be concluded that both the rimfire ammunition cartridges 10 and the powerload cartridges 40 are satisfactory for their respective intended uses as a lead-free primed, non-toxic rimfire cartridges.

Using the primer compositon shown in Table 5, one mol of gaseous exhaust products from this formulation would have the characteristics given in Table 9.

TABLE 9

ONE MOL OF EXHAUST

| Exhaust Species | Mol Fraction |
|---|---|
| CO | .206 |
| $CO_2$ | .240 |
| $H_2O$ | .144 |
| $N_2$ | .296 |
| SrO | .072 |
| other | .042 |

From Table 9, it can be concluded that the exhaust species from the primer of Table 5 are environmentally acceptable. Furthermore, it can also be concluded that in rimfire configurations having the primer composition described herein, the exhaust species from the primer composition comprise less than 10% of the total exhaust byproducts of the cartridge 10, 40. Thus, the most significant portion of the gaseous exhaust byproduct from firing a cartridge is contributed by the total propellant charge 90' and 92.

A presently preferred primer composition, designated the B-1 lead-free rimfire formulation or B-1 mix, is shown in Table 10 below. In the Table 10 composition, the mucilage binder used in the Table 5 primer composition has been replaced with a gum arabic (technical acacia) binder. To enhance quality control visual inspections of the primed casings, a green color producing ferricferrocyanide pigment is included. The preferred range of water in the wet composition of Table 5 is 14.5–15.5%, with much of this water being contributed by the dinol and tetracene which are mixed with water to insure safe handling. Rimfire cartridges having the B-1 Mix primer of Table 10 were assembled in accordance with the procedure set forth in Table 6, and they displayed performance characteristics comparable with those in Tables 7 and 8.

TABLE 10

| B-1 MIX INGREDIENTS | |
|---|---|
| Component | Percent Weight (dry basis) |
| dinol (diazodinitrophenol) | 22.30% |
| tetracene | 6.10% |
| propellant | 8.10% |
| ground glass | 30.00% |
| strontium nitrate | 32.92% |
| gum arabic binder | 0.50% |
| ferricferrocyanide pigment | 0.08% |

Another factor bearing on the performance of the primer described herein is the method of drying the charged rimfire cases (see FIG. 2). Most other primer compositions include a minimum water content to ensure safe handling of the composition during the manufacturing process. Once a wet pellet of such a damp primer mixture is metered into a casing and spun into place, the spun casing may be safely dried and subsequently handled. In general, primer compositions may be dried for some time and at a given temperature until all the water is driven off from the primer. The hotter the drying temperature used, the sooner the primer charges will be dried. The process of vacuum drying is also known in the industry, and in some cases it accelerates such drying.

It is apparent to those skilled in the art that there exists some temperature threshold at which the less stable ingredients may begin to undergo decomposition. For example, tetracene decomposes to the extent that it suffers a 23% weight loss in the first forty-eight hours at 100° C. Therefore, in the illustrated embodiment drying operations may be conducted at a temperature below 100° C., such as 60° C.

However, the primer described herein uses a strontium nitrate oxidizer. This strontium nitrate oxidizer is preferably a pre-processed blend of anhydrous and tetrahydrate having a total moisture content on the order of 11.5–13%. Such an anhydrous/tetrahydrate blend negates the tendency of the oxidizer to absorb and give off molecular water during processing and storage. This concept is described in the Bjerke patent which is incorporated by reference above into this disclosure. The strontium nitrate oxidizer is significantly more soluble in water than the oxidizers used in previous primer compositions. Subsequently, when the primer 80 is dried, not only "free" water, but also molecular water of hydration must be evaporated. As this molecular water passes through the primer 80, it may be reabsorbed under some drying conditions. Thus, if the charged round (FIG. 2) is not dried in an appropriate manner, strontium nitrate can be redissolved, carried, and redeposited at some new location within the primer 80. This migration of the strontium nitrate can result in several undesirable conditions, including the creation of voids and fissures in the primer, as well as changing the chemical ingredient ratios within various areas of the charge.

We have found some instances where this migration-induced loss of charge integrity adversely affects the cartridge performance output. For example, in extremely severe drying conditions, such as a hot and rapid vacuum drying on the order of 200° F. for less than 15 minutes, the combination of saturated water transmigration and binder-induced surface tension may lead to actual physical breakage of the primer 80. This breakage may occur as the primer 80 forms a surface "skin" which traps water vapor therein and leads to bubbling during the drying process.

Conversely, if the charged rimfire cases are dried at temperatures at or barely over room temperature for an extended period, the original water remains in contact with the soluble strontium nitrate which may then become saturated. Depending upon the ambient humidity, air circulation, etc., to which the charged cases are exposed, this drying procedure can take one half to several days. Finally, when all the water is driven from the charge, although there is no bubbling, the primer surface will be coated with a deposit of the strontium nitrate oxidizer.

We have found that optimum charge integrity and resultant cartridge performance may be obtained by drying the primer composition between 100° F. and 200° F. for a period of 72 hours. The test rounds described above with respect to Tables 5–8 and 10 performed in a satisfactory manner and were manufactured using a vacuum oven drying process. Specifically, these test rounds were dried for two cycles, each of a 30 minute duration, at 110° ±° F. and at a vacuum pressure of 28 inches Hg. Vacuum drying is preferred over air drying for manufacturing purposes, due to the speed of vacuum drying relative to that of air drying. Of course, other variations in the drying parameters may also be suitable, such as vacuum drying at 28 inches Hg for two 45 minute cycles at 90±5° F. These variations may also depend upon variations in the casing size and variations of the primer compositions within the guidelines described above.

It will be apparent to those skilled in the art that a primer having a composition within the ranges set forth herein, as well as its subsequent processing, in terms of propellant tamping with tamping tool T and the specialized drying technique described above, is quite satisfactory in terms of meeting the functional requirement of the finished cartridges 10, 40, as well as meeting environmentally acceptable gaseous exhaust product compositions.

Having illustrated and described the principles of our invention with respect to a preferred embodiment, it should be apparent to those skilled in the art that our invention may be modified in arrangement and detail without departing from such principles. For example, other sizes of rimfire cartridges may be employed, as well as suitable material substitutions and quantity variations for several of the components of the lead-free primed rimfire cartridge system. We claim all such modifications falling within the scope and spirit of the following claims.

We claim:

1. A rimfire cartridge comprising:

a generally cylindrical rimfire casing having a cylindrical wall, an enclosed end, an an opposing end, with the enclosed and defining therein a rimfire primer annular cavity;

a primer consolidated into, dried and secured within the annular cavity, said primer having a lead-free compositoin comprising diazodinitrophenol, tetracene, propellant, glass, and strontium nitrate;

a predetermined amount of propellant overlying the dried primer in the casing, the predetermined amount of propellant comprising a metered amount of a first propellant tamped at a predetermined pressure of between 1,300–8,800 psi into the casing to form a first propellant layer to secure the dried primer within the annular cavity; and sealing mans for sealing the opposing end of the casing.

2. A rimfire cartridge according to claim 1 wherein the the cartridge further includes a second metered amount of a propellant forming a second propellant layer overlaying the tamped first propellant layer.

3. A rimfire cartridge according to claim 1 wherein the metered amount of the first propellant comprises at least 50 milligrams thereof.

4. A rimfire cartridge according to claim 2 wherein the second propellant layer comprises a nontamped.

5. A rimfire cartridge according to claim 2 wherein the second propellant has a composition that that of the first propellant.

6. A rimfire cartridge according to claim 1 wherein the primer comprises, by weight on a dry basis, about 4–20% tetracene, 20–30% diazodinitrophenol, 20–40% strontium nitrate, 20–35% glass, and 0.2–2.2% water-soluble binder.

7. A rimfire cartridge according to claim 1 wherein the primer comprises, by weight on a dry basis, about 22% diazodinitrophenol, 8% propellant, 6% tetracene, 32% strontium nitrate, 30% glass, and 2% mucilage binder.

8. A rimfire cartridge according to claim 1, wherein the primer comprises, by weight on a dry basis, about 30% glass, 22% diazodinitrophenol, 6% tetracene, 8% propellant, 33% strontium nitrate, 0.5% gum arabic binder, and 0.08% ferricferrocyanide pigment.

9. A rimfire cartridge comprising:

a generally cylindrical rimfire casing having a cylindrical wall, an enclosed end, and an opposing end, with the enclosed end defining therein a rimfire primer annular cavity;

a primer consolidated into, dried and secured within the annular cavity, the primer having a lead-free composition which comprises by weight on a dry basis, about 20–30% diazodinitrophenol, 4–20% tetracene, 20–40% strontium nitrate, 20–35% glass, and 0.2–2.2% water soluble binder;

at least 50 milligrams of a first propellant layer tamped into the casing at a predetermined pressure selected from the range of 1,300–8,800 psi to substantially lock the dried primer within the annular cavity; and sealing means for sealing the opposing end of the casing.

10. A rimfire cartridge according to claim 9 wherein the cartridge further includes an additional amount of a nontamped second propellant layered over the tamped first propellant layer.

11. A rimfire cartridge according to claim 10 wherein the second propellant has a composition different than that of the first propellant.

12. A rimfire cartridge for a powerload according to claim 9 wherein the sealing means comprises a crimp formed in the casing cylindrical wall adjacent the opposing end of the casing.

13. A rimfire cartridge for ammunition according to claim 9 wherein the sealing means comprises a bullet crimped in the casing opposing end.

* * * * *

UNITED STATES PATENT AND TRADEMARK OFFICE

CERTIFICATE OF CORRECTION

PATENT NO. : 5,216,199

DATED : June 1, 1993

INVENTOR(S) : Robert J. Bjerke, et al

It is certified that error appears in the above-indentified patent and that said Letters Patent is hereby corrected as shown below:

Column 2, line 63, "as ,the fuel" should be --as the fuel--.

Column 8, line 41, "picramate hydrochloric" should be --picramate, hydrochloric--.

Column 8, line 52, "6%," should be --6%--.

Column 12, line 14, "muCilage" should be --mucilage--.

Column 13, line 11, "buttet" should be --bullet--.

Column 16, line 43, "±°" should be --± 5°--.

Column 17, line 8, "an", first occurrence, should be --and--.

Column 17, line 14, "compositoin" should be --composition--.

Column 17, line 23, "mans" should be --means--.

Column 17, line 33, "nontamped." should be --nontamped propellant.--.

UNITED STATES PATENT AND TRADEMARK OFFICE

CERTIFICATE OF CORRECTION

PATENT NO. : 5,216,199

DATED : June 1, 1993

INVENTOR(S) : Robert J. Bjerke, et al

It is certified that error appears in the above-indentified patent and that said Letters Patent is hereby corrected as shown below:

Column 17, line 36, "that that" should be --different than that--.

Signed and Sealed this

Thirty-first Day of May, 1994

Bruce Lehman

*Attest:*

BRUCE LEHMAN

*Attesting Officer*

*Commissioner of Patents and Trademarks*